United States Patent [19]

Osuga

[11] Patent Number: 4,656,915

[45] Date of Patent: Apr. 14, 1987

[54] TREMOLO MECHANISM FOR GUITAR

[76] Inventor: Tamotsu Osuga, 21-2, 1-chome, Yoyogi Shibuya-ku, Tokyo, Japan

[21] Appl. No.: 711,966

[22] Filed: Mar. 14, 1985

[51] Int. Cl.[4] ..... G10D 3/00

[52] U.S. Cl. ..... 84/313; 84/297 R

[58] Field of Search ..... 84/297 R, 298, 299, 84/312 R, 313

[56] References Cited

U.S. PATENT DOCUMENTS

| | | | |
|---|---|---|---|
| 3,580,124 | 5/1971 | Mancini | 84/313 |
| 4,457,201 | 7/1984 | Storey | 84/313 |
| 4,512,232 | 4/1985 | Schaller | 84/313 |
| 4,549,460 | 10/1985 | Gressett, Jr. et al. | 84/298 |

*Primary Examiner*—Benjamin R. Fuller

*Attorney, Agent, or Firm*—Frishauf, Holtz, Goodman & Woodward

[57] ABSTRACT

A tremolo mechanism for a guitar provides a tremolo effect. The mechanism is provided with a device against which the strings are pressed, and which is rotatable round a rotary shaft located between the bridge and the string-fixing part of the guitar, the device being capable of changing the tension, in each string by rotating about the rotary shaft and thereby changing the distance from the axis of the rotary shaft to the point at which each string presses against the device.

23 Claims, 16 Drawing Figures

TREMOLO MECHANISM FOR GUITAR

BACKGROUND OF THE INVENTION

The present invention relates to a tremolo mechanism for a guitar by which the string tension is temporarily and gradually reduced to give a tremolo effect.

Well known conventional tremolo mechanisms for guitars are either of the so-called Fender type or the Kahler type. Of those two types, the Fender type of tremolo mechanism has, as shown in FIG. 2 and FIG. 3, an end plate 5 which consists of a bridge 2 and a string-fixing part 4 for strings 3 on the front of the body of the guitar, assembled as one unit. The end plate 5 is mounted on the guitar body 1 so that it can rotate about a fulcrum 6. The tension in the strings 3 is gradually reduced to give a tremolo effect by the rotation of the end plate 5 obtained by pressing the tremolo arm against the force of a spring 7.

With the tremolo mechanism of the Fender type shown in FIG. 3, length from the finger board to the bridge of the sixth string (3-6) is slightly longer than that of the first string (3-1) because of the placement of the bridge 2 at an angle to the parallel strings. Since the diameter of the strings 3 increases from the first string (3-1) to the sixth string (3-6), when the strings are pressed while playing the guitar, the thin first string (3-1) touches the finger board 9 even when it is pressed lightly by a finger toward the finger board 9, while the thick sixth string (3-6) must be pressed by a large force toward the finger board 9, and a round portion of the string (3-6) touches the finger board 9. The reason why the bridge 2 is positioned obliquely is to compensate for the shortening in the lengths of the string in various scales due to the rounded contact of the sixth string (3-6) with the finger board, and a thicker string requires more compensation than a thinner string. In this arrangement, the distance from the bridge 2 to the string-fixing part 4 is shorter for the sixth string (3-6) than for the first string (3-1). As a result, when the tremolo arm 8 is pressed down, the reduction in tension of the sixth string (3-6) is larger than that of the first string (3-1). However, since the first string (3-1) which has a smaller reduction in tension has a smaller diameter than the thick sixth string (3-6), and its sensitivity to tone variations due to the reduction in string tension is low, the first string has a small variation of about 2 or 3 tones. On the other hand, the sixth string which has a larger reduction in tension has a small ratio of elongation because of its larger diameter, and it is more sensitive to tone variations caused by this reduction in the tension. It may therefore give a variation of about 6 or 7 tones. For this reason, the Fender type of tremolo mechanism gives different tremolo effects for the different strings when the tremolo arm is pressed, the tremolo effects provided for the most-used strings (3-1) through (3-3) are weak but the tremolo effect for the sixth string (3-6) is too large, and sometimes the heavier strings lose too much tension and are liable to go out of tune, so that it is impossible to provide tremolo with a harmonized chord. This is a disadvantage of Fender type of mechanism.

With a tremolo mechanism of the Kahler type shown in FIG. 4, a frame 12 is fixed onto the guitar body 10 by screws 11 and a rotor 16 is mounted on the frame 12. The rotor 16 rotates about a shaft 15 when a tremolo arm 14 is pressed against the force of a spring 13. The rotor 16 is provided with a fixing part 18 that fixes each of strings 17. A bridge roller 19 that supports each string is fixed so that it does not rotate when the tremolo arm 14 is pressed down. The tremolo effect is obtained by shifting only the string-fixing part 18 by the rotation of the rotor 16, which is done by pressing the tremolo arm 14. Since the position of the bridge roller 19 is fixed in the Kahler type of mechanism, the reduction in the string tension produced by pressing the tremolo arm is the same for all the strings, and it is impossible to vary the reduction in string tension according to the differences in the rates of elongation of the strings. Consequently the Kahler type of tremolo mechanism fails to provide the same tremolo effect for all the strings, and this is a disadvantage of this type of mechanism.

Both the Fender type and the Kahler type of mechanism depend solely on spring force for returning the tremolo arm to its original position after it is released. Especially when the distance moved by the pressed tremolo arm is large, it may fail to return to its original position because the spring quality is inadequate, or for other reasons. This is another disadvantage of both types of mechanism.

OBJECTS OF THE INVENTION

The object of the present invention is to provide a tremolo mechanism which is capable of providing an appropriate tremolo effect for each string according to the variations in string diameter, the rate of elongation of the strings and their materials, and also according to the wishes of the player, to provide a tremolo mechanism that can give a harmonized chord, for instance. The present invention provides, as shown in FIG. 1, a tremolo mechanism for a guitar which gives a tremolo effect by temporarily changing the tension in strings 23 stretched between a head 21 and a body 22 of a guitar 20. A member 28 rotates around a shaft 27 when tremolo arm 26 is pressed toward guitar body 22. Shaft 27 has its axis positioned transversely to strings 23. Shaft 27 is constructed so as to resiliently twist as member 28 rotates. Member 28 is provided with a portion **28*a* against which strings 23 press. Portion 28*a* is positioned between a bridge 24 which supports each of strings 23 and a fixing part 25 which attaches the end of each string to the front of guitar body 22. Fixing part 25 is connected to member 28 and rotates along with it. Fixing part 25 includes means, individual to each string, for changing the distance from the axis of shaft 27 to the point at which each string 23 contacts portion 28*a*. Consequently, as member 28 is rotated, it is possible to change the tension in each of strings 23**.

Another object of the present invention is to provide a tremolo mechanism whose tremolo arm rotates exactly as desired when pressed, and in which the braking strength of the tremolo arm can be adjusted according to the wishes of the player.

A further object of the present invention is to provide a tremolo mechanism in which the tremolo arm returns exactly to its original position, even if the stroke of the tremolo arm (the distance over which the tremolo arm can travel) is large and the tremolo arm is pressed through a large stroke.

Still other object of the present invention is to provide a tremolo mechanism that can be used without the spring which is provided in a conventional tremolo mechanism.

DETAILED DESCRIPTION OF THE PREFERRED EMBODIMENTS

Figure 1:
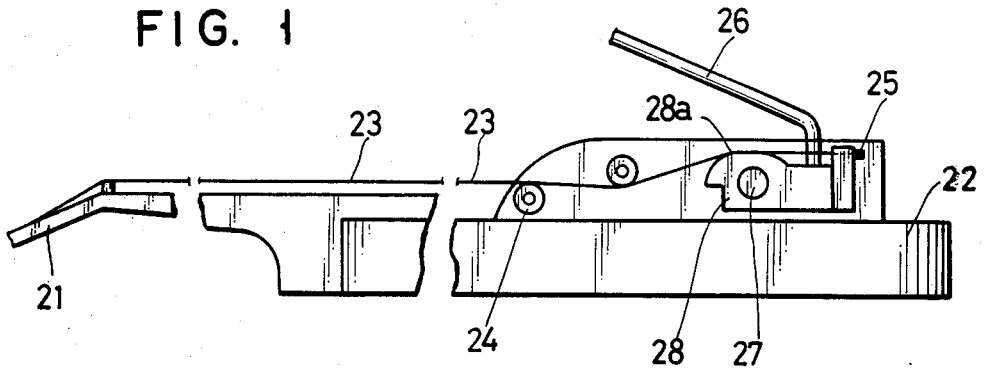
FIG. 1 is a schematic view of the construction of the whole of the mechanism of the present invention.
Figure 2:
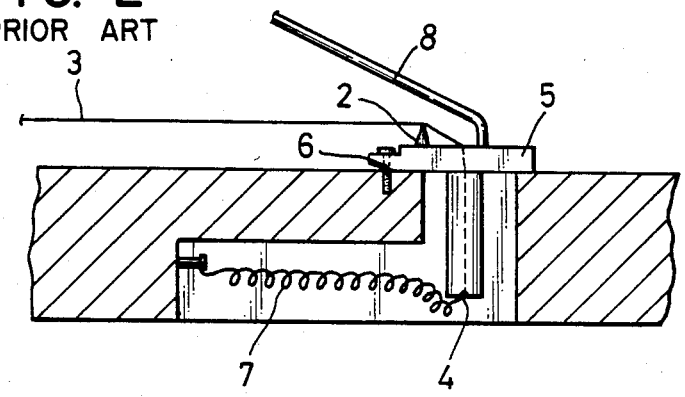
FIG. 2 PRIOR ART
FIG. 2 is a schematic cross-section1ed side elevation of a conventional tremolo mechanism.
Figure 3:
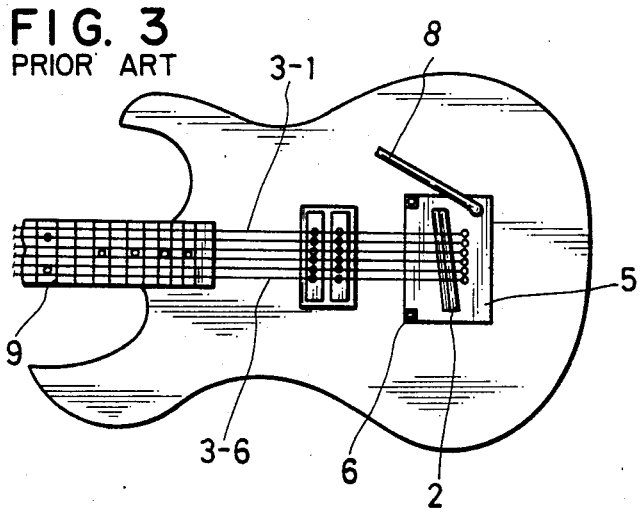
FIG. 3 PRIOR ART
FIG. 3 is a schematic front elevation of the tremolo mechanism of FIG. 2.
Figure 4:
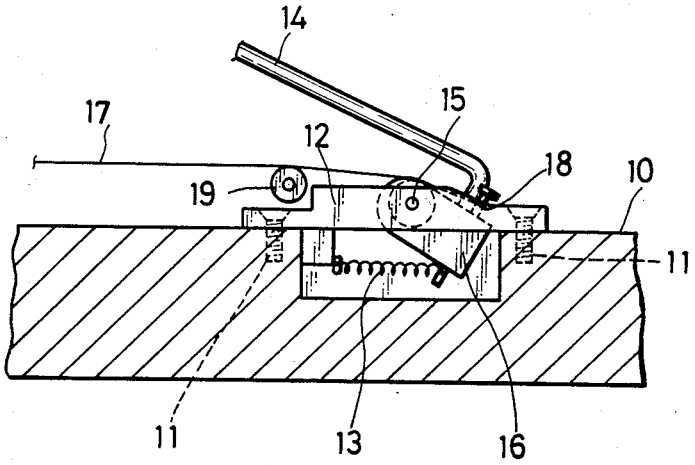
FIG. 4 PRIOR ART
FIG. 4 is a schematic side elevation of another conventional tremolo mechanism.
Figure 5:
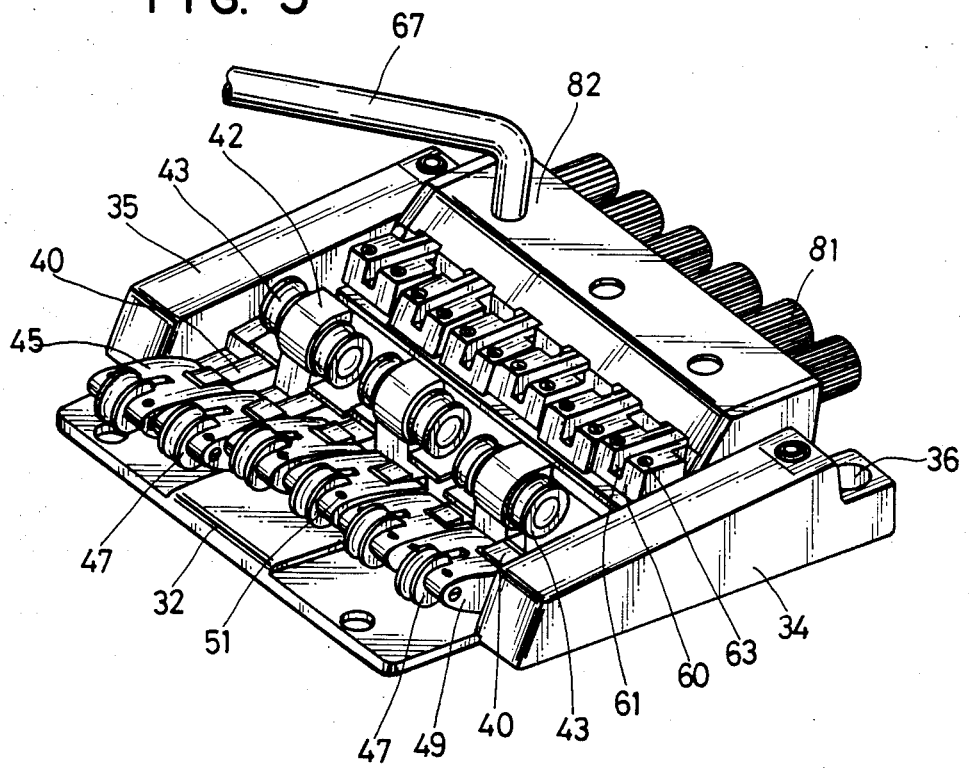
FIG. 5 is a perspective view of a a tail device that comprises the tremolo mechanism of the present invention.
Figure 6:
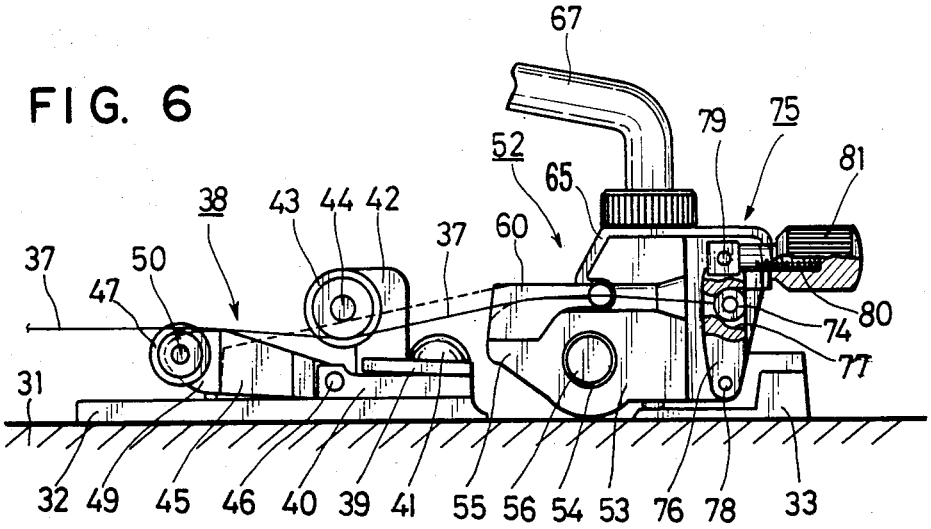
FIG. 6 is a cross-sectioned side elevation of the essential parts of the mechanism of FIG. 5.
Figure 7:
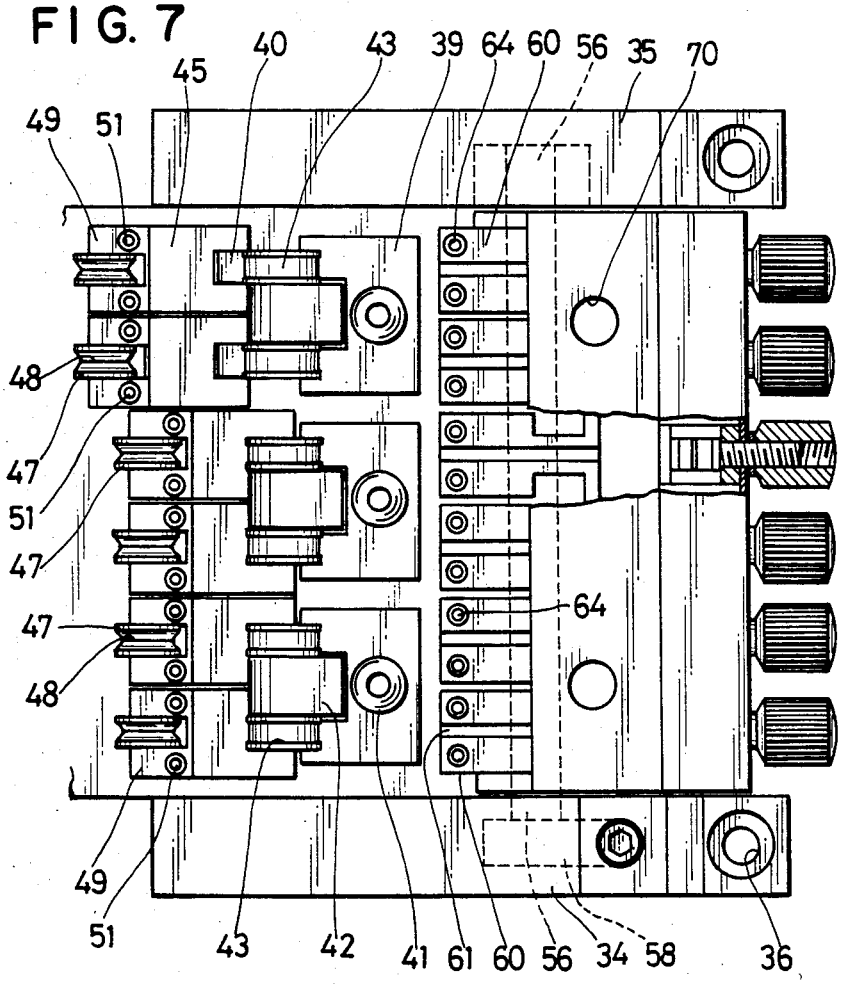
FIG. 7 is a plan view of the essential parts of the mechanism of FIG. 5.

Embodiments of the present invention will now be described with reference to the attached drawings.

In FIGS. 5 through 14, numeral 31 denotes a guitar body. Right and left frames 34 and 35, which are formed as one unit with a front plate 32 and rear plate 33, are mounted onto the body by screws 36.

Part of the front plate 32 projects from the front ends of the right and left frames 34 and 35. The front plate 32 is provided with a bridge member 38.

A bridge press board 39 is mounted on the front plate 32 by screws 41 in such a fashion that it presses bridge joints 40 onto the front plate 32, and brackets 42 supporting tension rollers 43 are also mounted onto the front plate 32 by screws. A roller 43 for each of the strings is rotatably supported on one of the brackets 42 by a shaft 44. Each roller 43 is a tension roller for a string 37 which acts to tighten the tension in the string 37 when it is pressed by a finger. A bridge piece 45 is mounted rotatably on each bridge joint 40 by a pin 46.

Each bridge piece 45 is designed to support on a shaft the bridge roller 47 for the corresponding string, which is provided with a groove 48 on its outer periphery to support the string 37. This bridge piece 45 has a pair of support parts 49 which are symmetrical in form and are separated by a certain distance, and a bridge roller 47 is installed rotatably on a shaft 50 between the pair of support parts 49. The position of each bridge piece 45 can be adjusted in the vertical direction by means of screws 51 that pass through the support sections 49 in the vertical direction and, at the same time, the longitudinal position of the bridge piece 45 can also be adjusted by moving its bridge joint 40 back and forth (to the right and left in FIG. 6) and then tightening its screw 41.

In addition, a member 52 is provided between the side frames 34 and 35, whereby the tension of the string 37 can be temporarily reduced while playing the guitar, to provide tremolo. Member 52 includes main rotor 53, shaft 56, and bend adjustment piece 60.

Main rotor 53 has a cylindrical hollow portion 54 extending transversely to strings 37 and a shaft 56 that goes coaxially through the hollow portion 54 of the main rotor 53 between the left and right frames 34 and 35. One end of the main rotor 53 is supported rotatably on the right frame 35 while the other end is free, and one end of the shaft 56 is securely fixed on the left frame 34 via a cam plate 58. The other end of the shaft 56 is fixed to the main rotor 53, by a pin (not shown).

Figure 8:
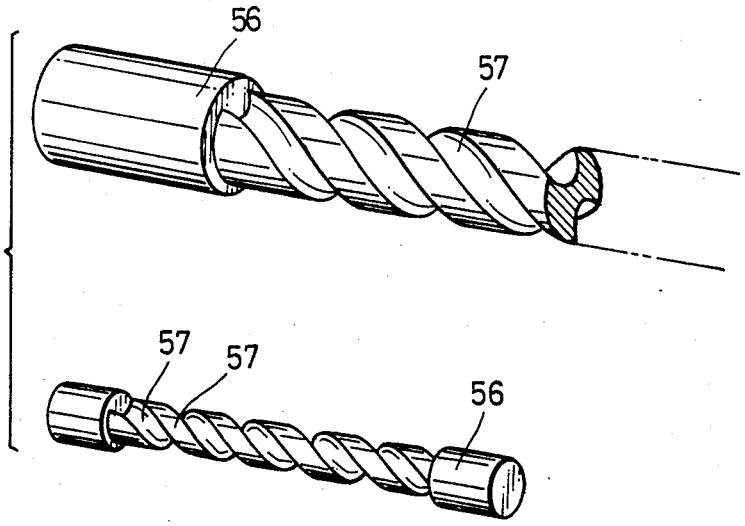
FIG. 8 is a perspective view of the rotary shaft of the mechanism of FIG. 5, and an enlarged view of its essential parts.

The shaft 56 consists, as shown in FIG. 8, of a torsion bar into whose outer face, except at least both ends, is cut one or more spiral grooves 57, and the shaft has an opposing force against its own twisting. In the above arrangement, it is ensured that when a rotating force is applied to the main rotor 53, one end of shaft 56 is kept from being rotated because it is fixed to the left frame 34 via the cam plate 58, while the other end thereof is rotatable with the main rotor 53 due to the two being fixed to each other, thereby causing the shaft to be twisted by the rotation of the main rotor.

The main rotor 53 comprises plate pieces 55 that project forward, and bend adjustment pieces 60 are provided on the plate pieces 55, one for each string. Each bend adjustment piece is pressed down by the tension of its string 37.

Figure 9:
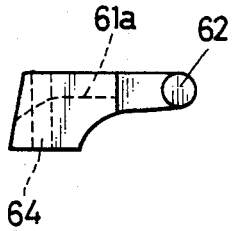
FIG. 9 is a side elevation of the string tension adjustment device of the tremolo mechanism of an embodiment of the present invention.
Figure 10:
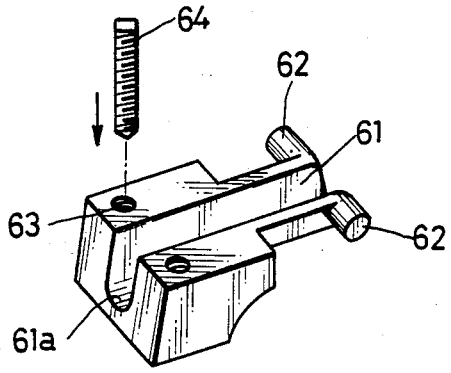
FIG. 10 is a perspective view of the string tension adjustment device of FIG. 9.
Figure 11:
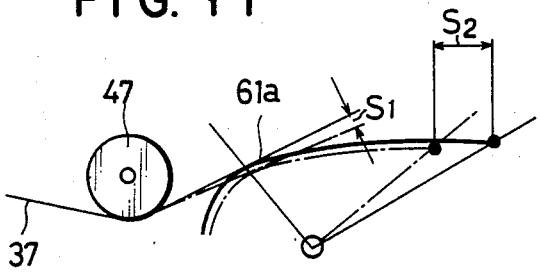
FIG. 11 is a diagram showing the string tension adjustment device of FIG. 9.

Each bend adjustment piece 60 has, as shown in FIGS. 9 through 11, at its central portion a groove 61 which extends longitudinally and is pressed by the string 37 at its center. Pins 62 that extend laterally outward are provided behind the groove 61. A pair of screw holes 63 are bored through positions on the front of each bend adjustment piece 60. The holes are on opposite sides of piece 60 and having the groove 61 therebetween. A screw shaft 64 is screwed into each screw hole 63. The bend adjustment piece 60 is fixed to the plate piece 55 because its base section is pressed down by a fine tuner cover 82 that will be described below. Therefore, the bend adjustment plate 60 is rotated with the main rotor 53 as it rotates, and each bend adjustment piece 60 can be rotated about the pin 62 as by adjusting the projection of the screw shaft 64 from the bottom end of the screw hole 63 due to the vertical movement of the screw shaft 64. The longitudinal section of a surface 61*a* which is a portion of the groove 61 in the bend adjustment piece, and which is pressed down by the string 37, is formed as an oval curve, so that the distance to the pressed-down position of the string 37 along the contact surface 61a from the axis of the rotary shaft 56 as the main rotor 53 rotates in the counterclockwise direction in FIG. 6 decreases gradually at a certain rate of change. Consequently, the degree of tension for each of strings 37 can be varied through adjustment of the projection of screw shaft 64 from the bottom end of screw hole 63.

A fine-tuner frame 65 is mounted onto the main rotor 53 by a suitable connecting means such as screws. Bend adjustment pieces 60 are attached to frame 65 to form one unit with the main rotor 53, and a tremolo arm 67 is mounted onto the top of the fine tuner frames 65. The tremolo arm 67 rotates the main rotor 53 counterclockwise in FIG. 6 (in the direction of the arrow) causing shaft 56 to be twisted against the force of the shaft 56. This twisting movement occurs smoothly in that shaft 56 functions like a torsion bar with the spiral grooves having been formed in it.

Figure 12:
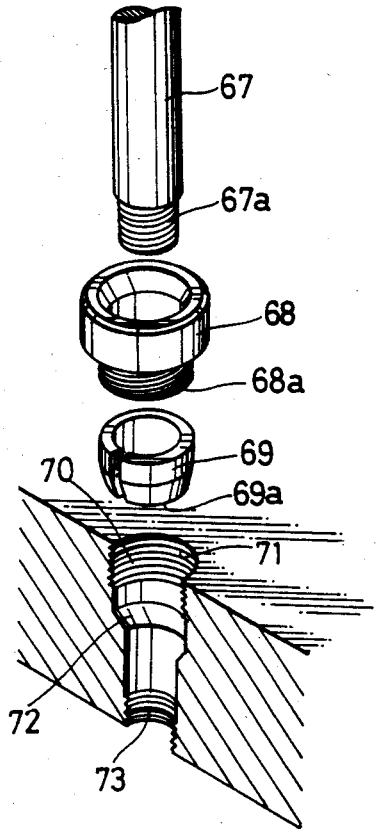
FIG. 12 is an exploded perspective view of the tightening device of the tremolo arm of the present invention.
Figure 13:
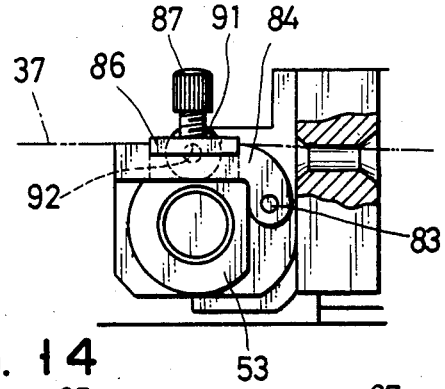
FIG. 13 is a partially cut-away cross-section showing the essential parts of another string tension adjustment device.
Figure 14:
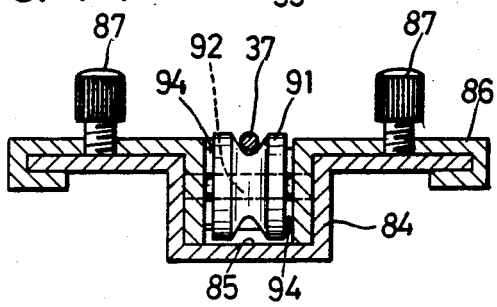
FIG. 14 is a cross-section through the essential parts of the string tension adjustment device of FIG. 13.

The tremolo arm 67 can give a tremolo effect while playing the guitar by pressing it down by the hand. As shown in FIG. 12, the arm 67 has a male thread 67*a* on its lower end; a sleeve 68 which has a diameter slightly larger than the outer diameter of the arm 67, and which has a male thread 68*a* cut on its lower end; and a bush 69 fitted onto the base portion of the arm 67; the bush being engaged with the lower end of the sleeve 68 and having an opening on one side so that the bush has a C-shaped cross-section to the bush and forms a tapered surface 69*a* for tightening which tapers downwards. The top of the fine-tuner frame 65 is provided with mounting holes 70 for mounting the tremolo arm 67. A female thread 71, tapered surface 72, and a female thread 73 that correspond respectively to the male thread of the sleeve 68, the tapered surface 69*a* of the bush, and the male thread 67*a* of the tremolo arm 67, are formed from top to bottom of the inner surface of each mounting hole 70. When the male thread 67*a* of the tremolo arm 67 is screwed into the female thread 73 and the male thread 68*a* of the sleeve 68 is simultaneously screwed into the female thread 71, the tapered surface 69*a* of the bush 69 is pressed against the tapered surface 72 to ensure the mounting of the tremolo arm 67 into the mounting hole 70.

The fine-tuner frame 65 is provided with a fine-tuner device 75 that fixes a bobbin-shaped end piece 74 which is mounted at the end of each string 37 and is capable of moving the position of this fixing longitudinally. The fine-tuner device 75 has a piece receiver 77 of a substantially semi-circular or conical cross-section that supports and fixes the end piece 74. The fine-tuner device 75 also has a tuner arm 76 for each string that can rotate about the pin 78 as center, a tuner rod 80 connected to the end of the tuner arm 76 by a pin 79, and a tuner nut 81 mounted on the tuner rod 80. The movement of the nut 81 rotates the tuner arm 76 about the pin 78, so that the tension in the corresonding string can be fine-tuned by shifting the fixing position of the end piece 74 longitudinally with respect to the body 31.

Numeral 82 denotes a cover which covers the fine tuner frame 65 and the main rotor 53.

In the tremolo mechanism as constructed above, when the tremolo arm 67 is pressed, the main rotor 53 rotates in the same direction around the axis, shaft 56 is twisted, and the bend adjustment pieces 60 linked to the rotation of the main rotor 53 and fine-tuner device 75 to which the body side end of each string 37 is fixed also rotate about the axis. Thus, when the rotor 53 is rotatd by presing tremolo arm 67, tension of the strings 37 is reduced by this rotation. Then, if the curve form of the contact surface 61*a* of each bend adjustment piece 60 is appropriately arranged for each corresponding string 37 considering its diameter, etc., as the contact surface 61a in the bend adjustment piece 60 is formed in the shape of an oval curve, it follows that tremolo can be obtained in harmony; and the tremolo effect can be changed by the angle of the tremolo arm 67 if the curve of the contact surface 61*a* has a certain shape.

Since each bend adjustment piece 60 can be rotated about the pin 62 by adjusting the vertical projection from its screw hole 63 of the screw shaft 64, the distance from the shaft of the rotary axis 56 to the portion of each string 37 which is pressed onto contact surface 61*a* can be changed for each string by turning the screw shafts 64 in the appropriate direction. This action serves to vary the degree of tension applied to each string as a result of pressing on tremolo arm 67. Thus, if this distance is changed beforehand so that the pitch of all the strings changes by, for instance, one tone when the tremolo arm 67 is pressed, the tremolo can be in harmony as well.

When the sleeve 68 provided at the base of the tremolo arm 67 is tightened, the tapered surface 69*a* of the bush 69 is pressed inward along the tapered surface formed in the mounting hole 70, and the tremolo arm 67 is tightened into the mounting hole 70 securely and with a large force, eliminating the danger of the mounting of the tremolo arm loosening without warning. In addition, if the play between the tremolo arm 67 and the main rotor 53 is adjusted, the tightness of the braking can be adjusted to the player's liking.

When tremolo arm 67 is pressed down toward guitar body 22, main rotor 53 rotates to cause shaft 56 to twist. When force is removed from tremolo arm 67, shaft 56 will act resiliently to restore tremolo arm 67 to its original position. Since the rotary shaft 56 has several spiral grooves cut into its outer circumference, the stresses developed in the shaft 56 when a rotational force is applied to it are parallel to the direction of the spirals. The stresses are therefore close to the tensile stresses in the same direction, which greatly increases the elastic limit of the shaft 56. Accordingly the spring used in a conventional tremolo mechanism is not needed, and the stroke of the tremolo arm is increased, so that a large stroke is used, there is no problem concerning the failure of the tremolo arm to return to its original position.

In FIGS. 13 through 16, a different example of the string tension adjustment device is shown.

In this example, rails 84 with a U-shaped cross-section which each has a groove 85 in its transverse direction is mounted aligned with the direction of the strings 37 is extended. One rail 84 is provided for each of the strings, and is mounted by a pin 83. A roller carrier 86 is fitted into each of the rails 84. The roller carrier 86 also has a U-shaped cross-section that corresponds to that of the rail. A pair of left and right screws 87 are provided in right and left sliding parts of the roller carrier 86 to fix the carrier 86 to the rail 84. When the screws 87 are loosened, the roller carrier 86 can slide along its rail 84, and when the screws 87 are tightened, the roller carrier 86 can be fixed to the rail 84 at any desired position.

Figure 15:
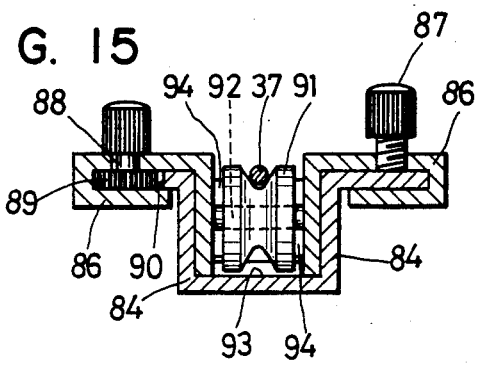
FIG. 15 is a cross-section through the essential parts of a different string tension adjustment device.
Figure 16:
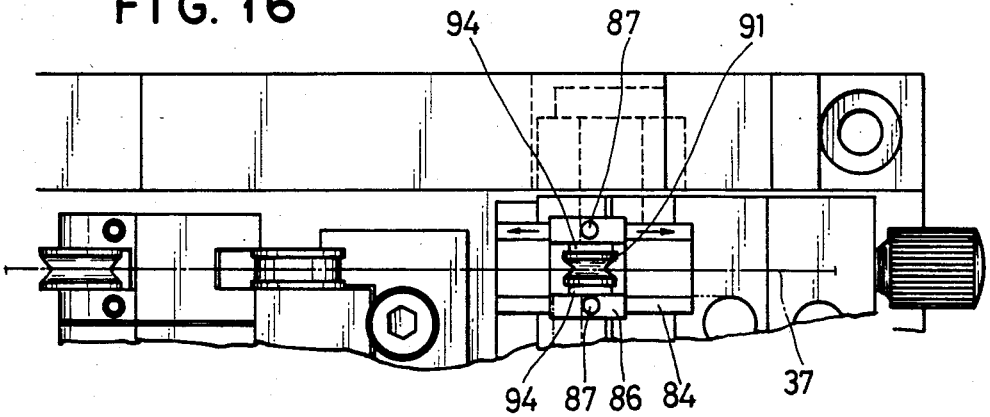
FIG. 16 is a partial plan view showing the mounting of the string tension adjustment device of FIG. 15.

In this case, as shown in FIG. 15, a pinion gear 89 supported on a rotary shaft 88 can be used instead of one of the screws 87. The pinion gear 89 meshes with a rack formed corresponding to the shape of the rail 88. Rotation of the pinion gear 89 can provide fine adjustment of the position at which the roller carrier 86 is fixed to the rail.

A roller 91 which supports a string 37 and against which the string 37 is pressed is supported on a shaft 92 in the central groove portion of the roller carrier 86. In order to prevent contact between the roller 91 and the roller carrier 86, a groove 93 is cut in the center of the bottom of the roller carrier 86. Plastic washers 94 are inserted into both sides of the roller 91 to make the roller rotate smoothly.

With this arrangement, the position at which the roller 91 is fixed, namely the position at which the string is pressed onto the roller 91, can be changed for each string to a desired position with respect to the axis of the main rotor 53. The pressing down of the tremolo arm can, therefore, change as desired the rate of change of tension in each string pressed onto its roller 91, while rotating the main rotor.

What is claimed is:

1. A tremolo mechanism for a guitar comprising:

a main rotor;

means supporting said main rotor for rotational movement relative to a guitar about a rotational axis extending generally tansverse to a set of strings on the guitar and generally parallel to a surface of the guitar over which said strings extend;

resilient means coupled to said main rotor to bias said main rotor to a first position at which no tremolo effect is provided and away from a second position at which a tremolo effect is provided;

a fixing means on the main rotor for securing one end of each of said strings to the main rotor;

tension adjustment means for individually varying the degree of tension to a different extent for each of said strings as said main rotor is rotated between its said first and second positions, the tension adjustment means being coupled to the main rotor for rotation therewith.

2. The tremolo mechanism for a guitar according to claim 1, wherein said tension adjustment means has a portion against which each of said strings is pressed into contact and each distance from the point of contact of one of said strings to said portion in contact with said string to the axis of said rotary shaft changes relative to said rotation together with the rotation of said rotating shaft.

3. The tremolo mechanism for a guitar according to claim 2, wherein said tension adjustment means comprises means for adjusting, for each of said strings, said change in distance from said portion which is in contact with said string to the axis of said rotary shaft.

4. The tremolo mechanism of claim 1, further comprising a tremolo arm extending at an angle from said rotational axis and adapted to extend away from said guitar surface, wherein said tremolo arm comprises a male thread formed around the outer periphery of a lower end of said tremolo arm, a sleeve at the lower end of said tremolo arm and which has a male thread around the periphery of the lower half thereof, and a bush with a tapered surface formed thereon, said tapered surface tapering towards the lower half of said sleeve and said bush engaging with a surface of said sleeve facing an axial direction of said tremolo arm at its base; said tremolo arm being mounted in a mounting hole provided on said main rotor; a female thread, a tapered surface, and a female thread that correspond respectively to the male thread at the lower end of said tremolo arm, the tapered surface of said bush, and the male thread of said sleeve being formed on the inner surface of said mounting hole.

5. The tremolo mechanism of claim 1, wherein the tension adjustment means comprises a member on the main rotor for each of said strings, each of said strings being pressed at a point of contact onto a surface of its corresponding member by virtue of the tension applied to it, each member being shaped to vary the distance from said rotational axis to said point of contact as said main rotor is rotated between its said first and second positions.

6. The tremolo mechanism for a guitar according to claim 5, wherein said means comprises:

a rail for each of said strings, mounted on said main rotor;

a roller carrier, and means to support said roller carrier for sliding along said rail in the direction in which said strings extend, and for fixing said roller carrier at any desired position on said rail; and a roller for each of said strings rotatably supported on the corresponding roller carrier by a shaft having a groove onto which the corresponding one of said strings is pressed into contact.

7. The tremolo mechanism of claim 5, wherein said surface of the member is arcuate.

8. The tremolo mechanism of claim 7, wherein said arcuate shape of said surface is customized for the different parameters of each string.

9. The tremolo mechanism of claim 8, wherein said arcuate-shaped surface of the member is oval.

10. The tremolo mechanism of claim 9, further comprising means to rotatably support said member around another axis substantially parallel to said rotational axis, and means to adjustably position said member around said other axis for setting the distance between said rotational axis and said contact point when the main rotor is in its said first position.

11. The tremolo mechanism of claim 10, wherein said resilient means comprises a shaft having its axis in parallel with said rotational axis.

12. The tremolo mechanism of claim 11, wherein said main rotor comprises a hollow bore which accommodates therein said shaft positioned coaxially with said rotational axis.

13. The tremolo mechanism of claim 11, wherein said main rotor has one end adapted to be rotationally coupled to one side of said guitar, said shaft has one end adapted to be fixed to a side of said guitar opposite to said one side, another end of said shaft being fixed to another end of said main rotor.

14. The tremolo mechanism of claim 13, wherein said shaft includes a groove formed therein and extending helically along its length and around its periphery.

15. The tremolo mechanism of claim 11, wherein said shaft includes a groove formed therein and extending helically along its length and around its periphery.

16. The tremolo mechanism of claim 7, wherein said arcuate-shaped surface of the member is oval.

17. The tremolo mechanism of claim 7, further comrising means to rotatably support said member around another axis substantially parallel to said rotational axis, and means to adjustably position said member around said other axis for setting the distance between said rotational axis and said contact point when the main rotor is in its said first position.

18. The tremolo mechanism of claim 5, further comprising means to rotatably support said member around another axis substantially parallel to said rotational axis, and means to adjustably position said member around said other axis for setting the distance between said rotational axis and said contact point when the main rotor is in its said first position.

19. The tremolo mechanism of claim 5, wherein said resilient means comprises a shaft having its axis in parallel with said rotational axis.

20. The tremolo mechanism of claim 19, wherein said main rotor comprises a hollow bore which accommodates therein said shaft positioned coaxially with said rotational axis.

21. The tremolo mechanism of claim 20, wherein said main rotor has one end adapted to be rotationally coupled to one side of said guitar, said shaft has one end adapted to be fixed to a side of said guitar opposite to said one side, another end of said shaft being fixed to another end of said main rotor.

22. The tremolo mechanism of claim 21, wherein said shaft includes a groove formed therein and extending helically along its length and around its periphery.

23. The tremolo mechanism of claim 19, wherein said shaft includes a goove formed therein and extending helically along its length and around its periphery.

* * * * *